United States Patent [19]

Jackel et al.

[11] Patent Number: 5,077,649

[45] Date of Patent: Dec. 31, 1991

[54] HEADLIGHT ADJUSTERS/SHUTTERS

[76] Inventors: Ozzie Jackel, 21 Royal Rd, Edmonton, Alta, Canada, T6J 2E7; George Spector, 233 Broadway, New York, N.Y. 10007

[21] Appl. No.: 502,229

[22] Filed: Mar. 30, 1990

[51] Int. Cl.[5] ..... F21V 17/02

[52] U.S. Cl. ..... 362/325; 362/279

[58] Field of Search ..... 362/279, 280, 321, 324, 362/325, 342, 354; 116/20

[56] References Cited

U.S. PATENT DOCUMENTS

| | | | |
|---|---|---|---|
| 1,236,966 | 8/1917 | Minetti et al. | 362/325 |
| 1,797,881 | 3/1931 | Schoen | 362/325 |
| 3,704,683 | 12/1972 | Summersby | 116/20 |

*Primary Examiner*—Carroll B. Dority

[57] ABSTRACT

A headlight adjustable shutter for a motor vehicle is provided in which light from the headlight can be reflected downwardly by adjustable louver shutter slats. In a modification each slat will contain an adjustable rear mirror to properly reflect the light therefrom.

4 Claims, 1 Drawing Sheet

HEADLIGHT ADJUSTERS/SHUTTERS

BACKGROUND OF THE INVENTION

The instant invention relates generally to motor vehicle headlight dimmers and more specifically it relates to a headlight adjustable shutter for a motor vehicle.

Numerous motor vehicle headlight dimmers have been provided in prior art that are adapted to deflect the light from headlights to reduce the glare during night driving. For example, U.S. Pat. Nos. 1,520,869 to Killam; 1,550,600 to Wilkie and 1,725,117 to Walthers all are illustrative of such prior art. While these units may be suitable for the particular purpose to which they address, they would not be as suitable for the purposes of the present invention as heretofore described.

SUMMARY OF THE INVENTION

A primary object of the present invention is to provide a headlight adjustable shutter for a motor vehicle that will overcome the shortcomings of the prior art devices.

Another object is to provide a headlight adjustable shutter for a motor vehicle in which light from the headlight can be directed anywhere it is needed by adjustable louver shutter slats such as in fog or snow.

An additional object is to provide a headlight adjustable shutter for a motor vehicle in which each slat contains an adjustable rear mirror to properly reflect the light therefrom.

A further object is to provide a headlight adjustable shutter for a motor vehicle that is simple and easy to use.

A still further object is to provide a headlight adjustable shutter for a motor vehicle that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
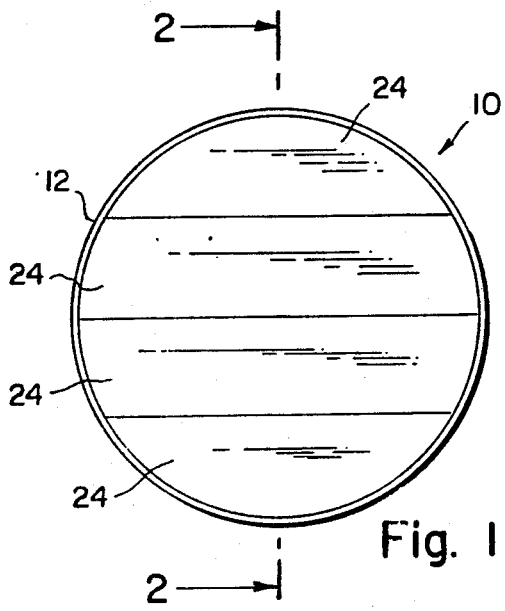
FIG. 1 is a front view of a round headlight with the invention connected thereto.
Figure 2:
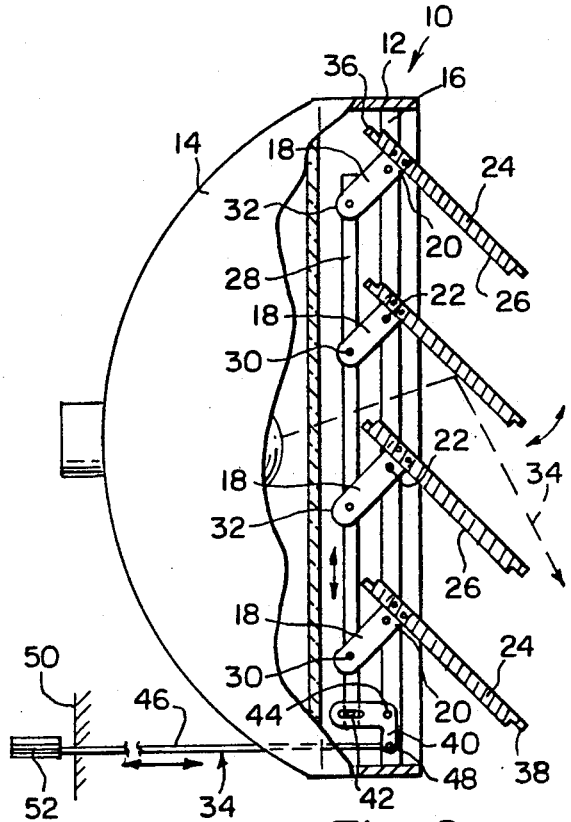
FIG. 2 is a side view with parts broken away as indicated by line 2—2 in FIG. 1.
Figure 4:
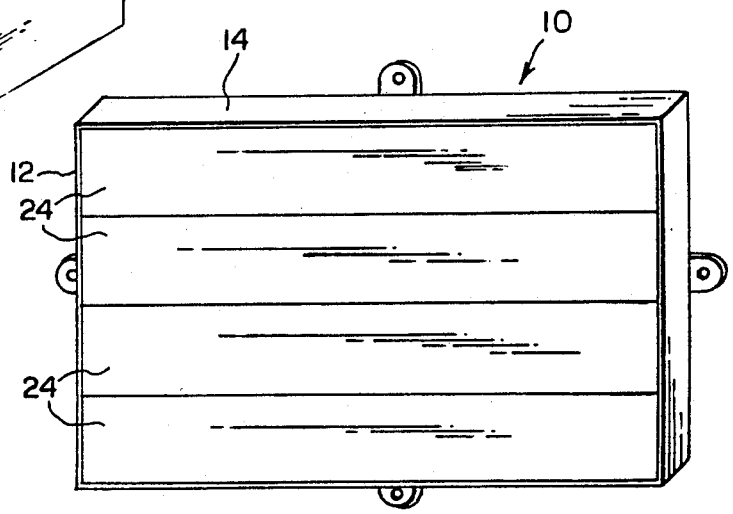
FIG. 4 is a front perspective view of a rectangular headlight with the invention connected thereto.

Turning now descriptively to the drawings, in which similar reference characters denote similar elements throughout the several views, FIGS. 1, 2 and 4 illustrate a headlight adjustable shutter 10 for a motor vehicle consisting of a casing 12 shaped to extend from forward end of a headlight 14 which can be round as in FIGS. 1 and 2 or rectangular as in FIG. 4. A vertical stanchion 16 is carried in the casing 12. A plurality of arms 18 are spaced apart and have their outer ends 20 pivotally connected at 22 to the stanchion 16. A plurality of louver shutter slats 24 are provided. Each slat 24 has a reflective rear surface 26 and is connected near its top edge to the outer end 20 of one of the arms 18. A vertically arranged control rod 28 is adapted to pivotally connect at 30 to each inner end 32 of the arms 18. An operating mechanism 34 is connected to the control rod 28 for permitting the manual adjustment of the slats 24 so that light 34 from the headlight 14 can be reflected downwardly to the ground.

Figure 3:
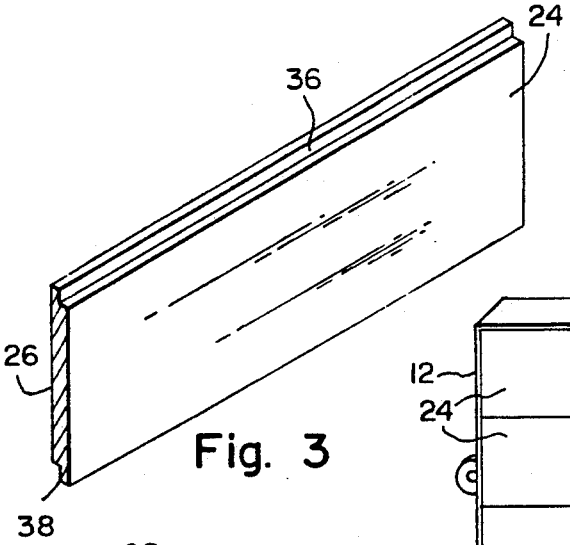
FIG. 3 is a perspective view of a portion of one of the louver shutter slats.

As best seen in FIG. 3, each slat 24 contains an outwardly stepped top edge 36 and an inwardly stepped bottom edge 38 so that when the slats 24 are placed in a closed position, as shown in FIGS. 1 and 4, they will fit snugly edge to edge together to prevent light from exiting therefrom.

The operating mechanism 34 includes an L-shaped crank lever 40 pivotally connected at 42 to lower end of the stanchion 16 in which one arm is pivotally connected at 44 to lower end of the control rod 28. An elongated cable 46 is connected to other arm of the L-shaped crank lever 40 at 48 and extends to dashboard 50 of the motor vehicle. A pull knob 52 is connected to distal end of the cable 46 to be manually operated for adjusting the slats 24.

Figure 5:
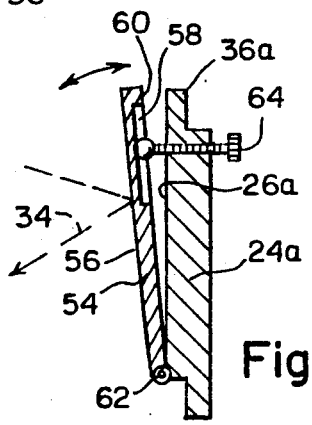
FIG. 5 is a side cross sectional view of a modification in which an adjustable mirror is spring pivotally hinged to rear surface of one of the louver shutter slats so that a set screw can adjust the mirror.

FIG. 5 shows a modified slat **24*a* wherein the reflective rear surface 26*a* includes a mirror 54 having a rear reflective surface 56 and a slot 58 formed in front surface 60. A spring biased pivot hinge 62 is disposed between bottom edge of the mirror 54 and rear surface 26*a* of the slat 24*a* so as to cause the front surface 60 of the mirror 54 to move toward the rear surface 26*a* of the slat 24*a*. A set screw 64 threadably extends through the slat 24*a* near the top edge 36*a* and is engageable with the slot 58 in the mirror 54 so that the set screw 64 can adjust the mirror to properly reflect the light 34** therefrom.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A headlight adjustable shutter for a motor vehicle comprising:

(a) a casing shaped to extend from a forward end of a headlight;

(b) a vertical stanchion carried in said casing;

(c) a plurality of arms spaced apart and having their outer ends pivotally connected to said stanchion;

(d) a plurality of louver shutter slats, each having means forming a reflective rear surface and connected near its top edge to the outer end of one of said arms;

(e) a vertically arranged control rod adapted to pivotally connect to each inner end of said arms;

(f) means operatively connected to said control rod for permitting the manual adjustment of said slats so that light from the headlight can be reflected downwardly to the ground.

2. A headlight adjustable shutter as recited in claim 1, wherein each said slat contains an outwardly stepped top edge and an inwardly stepped bottom edge so that when said slats are placed in a closed position they will fit snugly edge to edge together to prevent light from exiting therefrom.

3. A headlight adjustable shutter as recited in claim 2, wherein said operating means includes:

(a) an L-shaped crank lever pivotally connected to a lower end of said stanchion and having an arm pivotally connected to a lower end of said control rod;

(b) an elongated cable connected to another arm of said L-shaped crank lever and adapted to extend to a dashboard of a motor vehicle; and (c) a pull knob connected to a distal end of said cable to manually operate said slats.

4. A headlight adjustable shutter as recited in claim 3, wherein said means forming each reflective rear surface of each of said slats includes:

(a) a mirror having a rear reflective surface and a slot formed in a front surface;

(b) a spring biased pivot hinge between a bottom edge of said mirror and said slat so as to cause the front surface of said mirror to move toward the said slat; and (c) a set screw threadably extending through said slat near a top edge and engageable with the slot in said mirror so that said set screw can adjust said mirror to properly reflect the light therefrom.

* * * * *